US011795896B2

(12) United States Patent
Inui et al.

(10) Patent No.: US 11,795,896 B2
(45) Date of Patent: Oct. 24, 2023

(54) HIGH-PRESSURE FUEL PUMP

(71) Applicant: HONDA MOTOR CO., LTD., Tokyo (JP)

(72) Inventors: Hiroatsu Inui, Tokyo (JP); Noriaki Okano, Tokyo (JP); Takayuki Konuma, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/768,365

(22) PCT Filed: Oct. 31, 2019

(86) PCT No.: PCT/JP2019/042911

§ 371 (c)(1),
(2) Date: Apr. 12, 2022

(87) PCT Pub. No.: WO2021/084715

PCT Pub. Date: May 6, 2021

(65) Prior Publication Data

US 2023/0213010 A1 Jul. 6, 2023

(51) Int. Cl.
*F02M 59/10* (2006.01)
*F04B 9/04* (2006.01)

(52) U.S. Cl.
CPC ..... *F02M 59/102* (2013.01); *F04B 9/042* (2013.01)

(58) Field of Classification Search
CPC ..... F02M 59/102; F04B 9/042
USPC ..... 123/495–500, 507, 508
See application file for complete search history.

(56) References Cited

U.S. PATENT DOCUMENTS

| | | | | |
|---|---|---|---|---|
| 6,135,090 | A | 10/2000 | Kawachi et al. | |
| 6,694,952 | B1 | 2/2004 | Yamazaki et al. | |
| 6,763,808 | B2 | 7/2004 | Ryuzaki | |
| 10,125,749 | B2 * | 11/2018 | Mueller | F04B 49/065 |
| 11,053,898 | B2 | 7/2021 | Omori et al. | |

FOREIGN PATENT DOCUMENTS

| | | | |
|---|---|---|---|
| CN | 205858433 | U | 1/2017 |
| JP | H02-146256 | A | 6/1990 |
| JP | H11-200990 | A | 7/1999 |
| JP | 2001-041128 | A | 2/2001 |
| JP | 2001-263198 | A | 9/2001 |
| JP | 2009-144727 | A | 7/2009 |
| JP | 2019-138170 | A | 8/2019 |

* cited by examiner

*Primary Examiner* — Hai H Huynh
(74) *Attorney, Agent, or Firm* — Carrier, Shende & Associates P.C.; Joseph P. Carrier; Fulchand P. Shende

(57) ABSTRACT

In a reciprocating high-pressure fuel pump that operates a plunger while facing a cam ridge of a plunger driving cam provided on a camshaft to which power of a crankshaft of an internal combustion engine is transmitted, the cam ridge includes a cam curved surface including two apexes at a cam angle interval of 180° and two valley bottoms at a cam angle interval of 180° and alternately connecting the apexes and the valley bottoms, and a crossing angle between a first virtual line connecting the two apexes and a second virtual line connecting the two valley bottoms is not a right angle as viewed in a direction of a camshaft axis.

16 Claims, 8 Drawing Sheets

(#1 : FIRST CYLINDER、#2 : SECOND CYLINDER)

HIGH-PRESSURE FUEL PUMP

TECHNICAL FIELD

The present invention relates to a high-pressure fuel pump for an internal combustion engine, and more particularly to a high-pressure fuel pump for an unequal interval two-cylinder internal combustion engine.

BACKGROUND ART

A high-pressure fuel pump for an internal combustion engine in which cam ridges of a plunger driving cam are arranged at equal intervals, the cam ridges each having a symmetrical mountain shape on the ascending side and the descending side, is described in, for example, Patent Documents 1 and 2 below.

However, in the case of a plunger driving cam as disclosed in Patent Documents 1 and 2 below, in a two-cylinder internal combustion engine in which ignition timings at the time of combustion are unequal interval, for example, in an unequal interval two-cylinder four-stroke cycle internal combustion engine with a 270°/90° phase crank, the pressurization timing of the high-pressure fuel pump does not match with the fuel injection timing in the intake process prior to the combustion stroke.

Therefore, in the unequal interval two-cylinder internal combustion engine, it is conceivable to reduce a change in discharge pressure of the fuel by setting the pressurization timing of the high-pressure fuel pump at unequal intervals and to reduce the variation in the air-fuel ratio to improve the engine performance.

In the case of increasing the fuel pressure to a pressure at which cylinder fuel injection is possible, a plunger type high-pressure fuel pump is used. In this case, a pulsation damper reduces pressure fluctuation on the fuel suction-side caused by plunger operation.

However, when the cam ridges of the plunger driving cam is unevenly distributed in the camshaft circumferential direction in order to set the pressurization timing of the high-pressure fuel pump at unequal intervals, a flat part is generated in cam lift characteristics, and the plunger moves in two steps. This causes problems such as followability of the pulsation damper and vibration associated with fuel transfer becomes irregular.

Therefore, there is desired a high-pressure fuel pump having high accuracy for an unequal interval two-cylinder internal combustion engine while maintaining the operation characteristics of the high-pressure fuel pump.

PRIOR ART DOCUMENT

Patent Document

Patent Document 1: JP 02-146256 A (FIGS. 1 and 9)
Patent Document 2: JP 11-200990 A (FIGS. 1 and 3 to 5)

SUMMARY OF THE INVENTION

Underlying Problems to be Solved by the Invention

The present invention has been made in view of such a conventional technique, and it is an object of the present invention to provide a high-pressure fuel pump in which pressurization timing of the high-pressure fuel pump can be set at unequal intervals, the cam ridges of the plunger driving cam are continuously formed to generate no flat part in the cam lift characteristics and to make plunger operation be continuous and regular, and accuracy for the unequal interval two-cylinder internal combustion engine is high while operation characteristics of the high-pressure fuel pump are maintained.

Means to Solve the Problems

In order to solve the above problems, the present invention is a reciprocating high-pressure fuel pump that operates a plunger while facing a cam ridge of a plunger driving cam provided on a camshaft to which power of a crankshaft of an internal combustion engine is transmitted, the cam ridge including a cam curved surface that includes two apexes at a cam angle interval of 180° and two valley bottoms at a cam angle interval of 180° and alternately connects the apexes and the valley bottoms, and having a crossing angle that is not a right angle as viewed in a direction of a camshaft axis, the crossing angle being an angle between a first virtual line connecting the two apexes and a second virtual line connecting the two valley bottoms.

According to the above configuration, the high-pressure fuel pump can be provided in which, in the unequal interval two-cylinder internal combustion engine, pressurization timing of the high-pressure fuel pump can be set at unequal intervals, the cam ridges of the plunger driving cam are continuously formed to generate no flat part in the cam lift characteristics and to make plunger operation be continuous and regular, and accuracy for the unequal interval two-cylinder internal combustion engine is high while operation characteristics of the high-pressure fuel pump are maintained.

According to a preferred embodiment of the present invention, the crossing angle is approximately 67.5° on an acute angle side.

Therefore, the pump performance of the high-pressure fuel pump in the unequal interval two-cylinder four-stroke cycle internal combustion engine with the 270°/90° phase crank is improved.

According to the preferred embodiment of the present invention, the crossing angle is approximately 45° to 67.5° on an acute angle side.

By widening the angle on the discharge side, a discharge timing region in the unequal interval two-cylinder four-stroke cycle internal combustion engine with the 270°/90° phase crank is enlarged, and the engine can be controlled in a wide rotation range.

According to the preferred embodiment of the present invention, the crossing angle is approximately 67.5° to 90° on an acute angle side.

By making the cam angle on the descending side relatively wide, in the unequal interval two-cylinder four-stroke cycle internal combustion engine with the 270°/90° phase crank, the return of the plunger can be made gentle even with unequal intervals. Therefore, the load of the spring for returning the plunger can be reduced, and operation friction of the high-pressure fuel pump can be reduced.

According to the preferred embodiment of the present invention, the cam ridge has an ascending-side cam angle larger than a descending-side cam angle in a predetermined rotation direction.

Therefore, a fuel injectable area can be enlarged, and decrease in fuel discharge pressure can be reduced even when a fuel discharge period is large, and the internal combustion engine performance can be improved.

According to the preferred embodiment of the invention, the high-pressure fuel pump has the plunger driving cam provided coaxially with a valve camshaft of a valve train provided in an upper portion of a cylinder unit of the internal combustion engine.

Therefore, a structure of the internal combustion engine including the high-pressure fuel pump can be downsized.

According to the preferred embodiment of the present invention, the high-pressure fuel pump is provided in an upper portion of a cylinder unit of the internal combustion engine of a straddle type vehicle, and has a fuel pipe provided between the high-pressure fuel pump and a fuel tank located above the internal combustion engine.

Therefore, the fuel pipe can be shortened, the vibration of the fuel pipe can be reduced, and the layout properties of the fuel pipe is improved.

Effects of the Invention

According to the high-pressure fuel pump of the present invention, the high-pressure fuel pump can be provided in which, in the unequal interval two-cylinder internal combustion engine, pressurization timing of the high-pressure fuel pump can be set at unequal intervals, the cam ridges of the plunger driving cam are continuously formed to generate no flat part in the cam lift characteristics and to make plunger operation be continuous and regular, and accuracy for the unequal interval two-cylinder internal combustion engine is high while operation characteristics of the high-pressure fuel pump are maintained.

BRIEF DESCRIPTION OF DRAWINGS

FIG. 1 is a left side view of a motorcycle that is a straddle type vehicle including a high-pressure fuel pump according to an embodiment of the present invention, excluding a cover and the like.

MODE FOR CARRYING OUT THE INVENTION

Figure 1:
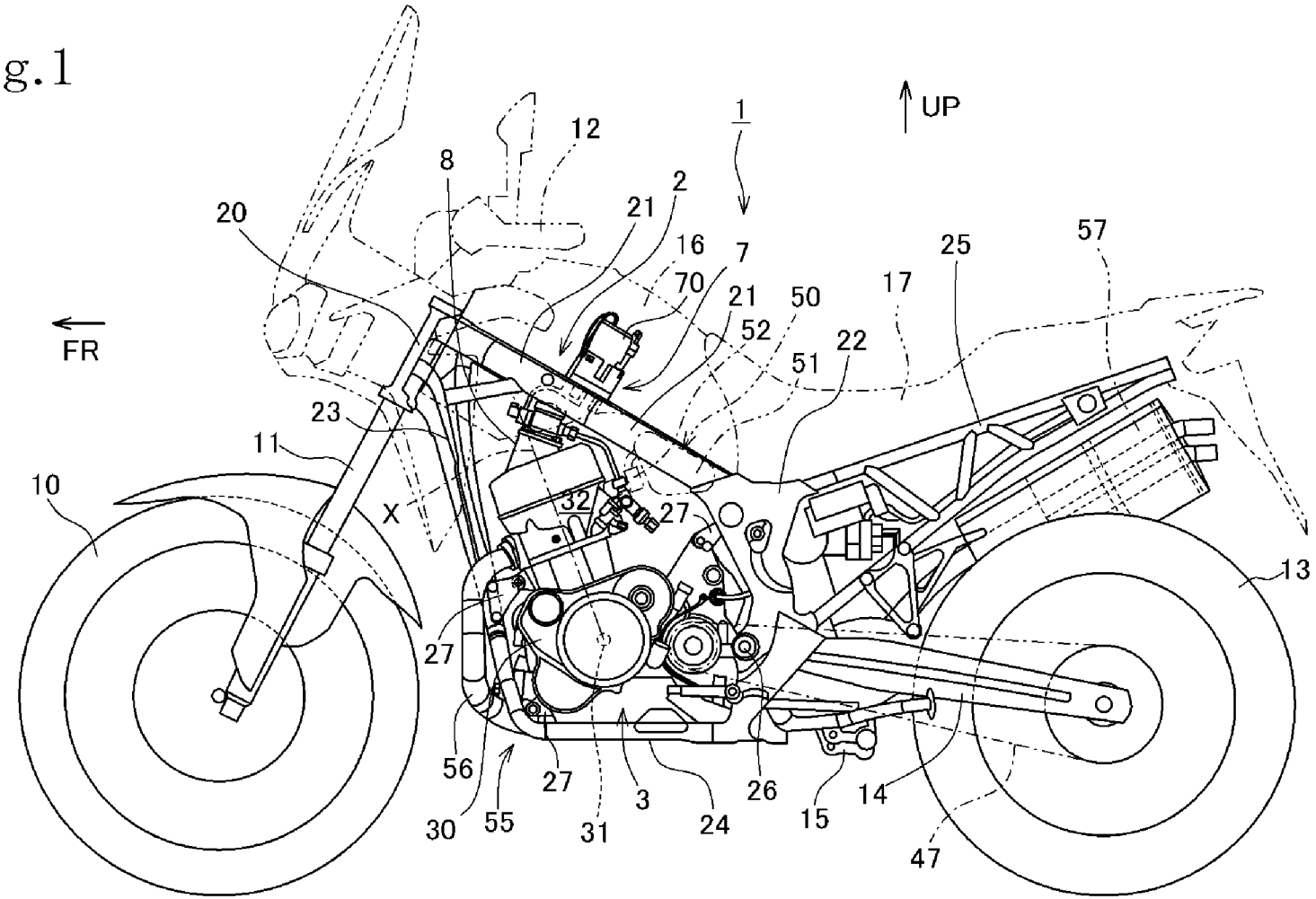

A high-pressure fuel pump according to an embodiment of the present invention is described with reference to FIGS. 1 to 8.

Note that the longitudinal, lateral, and vertical directions and the like in the description in this description and in claims follow vehicle directions of the straddle type vehicle according to the present embodiment. In the drawings, an arrow FR indicates the front of the vehicle, LH indicates the left of the vehicle, RH indicates the right of the vehicle, and UP indicates the top of the vehicle.

FIG. 1 is a left side view of a motorcycle 1 that is a straddle type vehicle including a high-pressure fuel pump according to an embodiment of the present invention, excluding a cover and the like.

A vehicle body frame 2 of a motorcycle ("straddle type vehicle" in the present invention) 1 includes a head pipe 20, a pair of left and right main frame members 21 extending obliquely rearward from the head pipe 20, a pair of left and right center frame members 22 extending downward from the rear end of the main frame members 21, a single down frame member 23 extending rearward and downward at a steep angle from the head pipe 20, a pair of left and right lower frame members 24 connected to the lower end of the down frame member 23, bifurcating obliquely leftward and rightward, descending, curving and extending substantially horizontally rearward, and connected to the lower ends of the pair of left and right center frame members 22, and a seat stay 25 extending rearward and slightly upward from the upper portion and the lower portion of the center frame members 22.

The head pipe 20 has a front fork 11 that supports a front wheel 10 steerably supported thereto, and the front fork 11 is connected with a steering wheel 12. In addition, a rear fork 14 that supports a rear wheel 13 is supported to be vertically swingable with a pivot part 26 at the lower portion of the center frame members 22 as a fulcrum, and a not-illustrated cushion unit is provided between the upper portion of the center frame members 22 and the rear fork 14 with a link mechanism 15 interposed therebetween.

The left and right main frame members 21 have a fuel tank 16 stored with fuel mounted thereon, and a tandem-integrated seat 17 for a driver and a passenger is mounted on the center frame members 22 and the seat stay 25. The fuel tank 16 includes a low-pressure fuel pump 70 that pressure-feeds the fuel in the fuel tank 16.

To the lower frame members 24 and the center frame members 22 of the vehicle body frame 2, an internal combustion engine 3 is mounted with a bracket 27 interposed therebetween. The internal combustion engine 3 is located below the fuel tank 6, and is mounted on the motorcycle 1 in a posture in which a crankshaft 31 is directed in the vehicle width direction and a cylinder axis X of a cylinder is slightly inclined forward.

The internal combustion engine 3 is an air-cooled two-cylinder four-stroke cycle internal combustion engine and is an upright internal combustion engine in which the cylinder axis X stands upright with respect to the horizontal plane. The internal combustion engine 3 is fastened and fixed to a crankcase 30 by such as a not-illustrated stud bolt with a cylinder unit 32 stacked on the crankcase 30.

Figure 2:
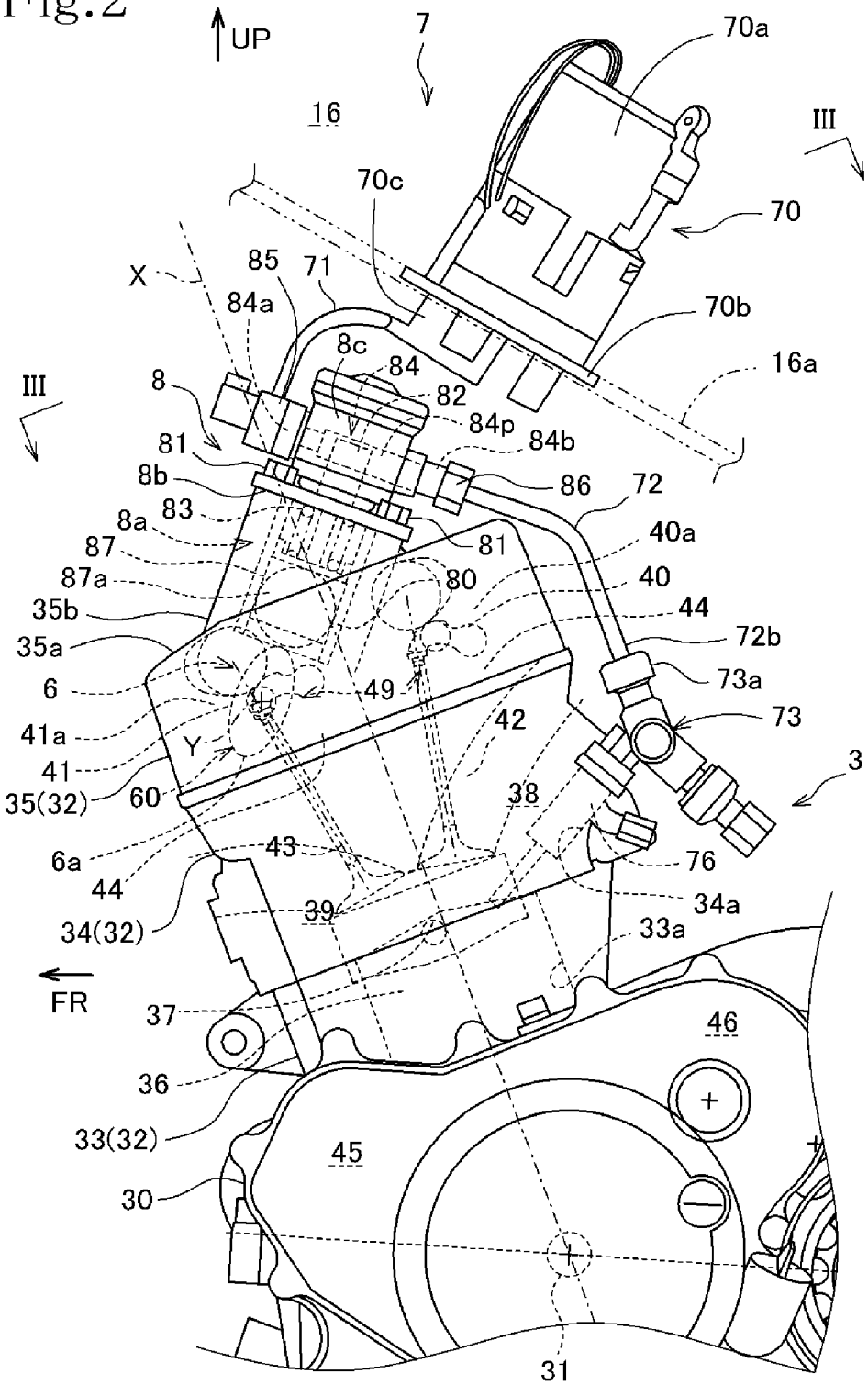
FIG. 2 is an enlarged view of a cylinder unit and a lower portion of a fuel tank in FIG. 1.

FIG. 2 is an enlarged view of the cylinder unit 32 and the lower portion of the fuel tank 16 in FIG. 1.

As illustrated in FIG. 2, the cylinder unit 32 includes a cylinder block 33 and a cylinder head 34 sequentially stacked on the crankcase 30, and a head cover 35 covering the upper surface of the cylinder head 34.

Note that the internal combustion engine 3 is an unequal interval two-cylinder four-stroke cycle internal combustion engine with a 270°/90° phase crank.

A not-illustrated camshaft holder is fastened and fixed on the cylinder head 34, and an intake-side camshaft 40 and an exhaust-side camshaft ("valve camshaft" in the present invention) 41 are rotatably supported by the cylinder head 34 and the camshaft holder. As illustrated in FIG. 2, the intake-side camshaft 40 is arranged on the rear side in the vehicle direction, and the exhaust-side camshaft 41 is arranged on the front side thereof. The cylinder head 34, the camshaft holder, the intake-side camshaft 40, and the exhaust-side camshaft 41 are covered with the head cover 35.

Figure 3:
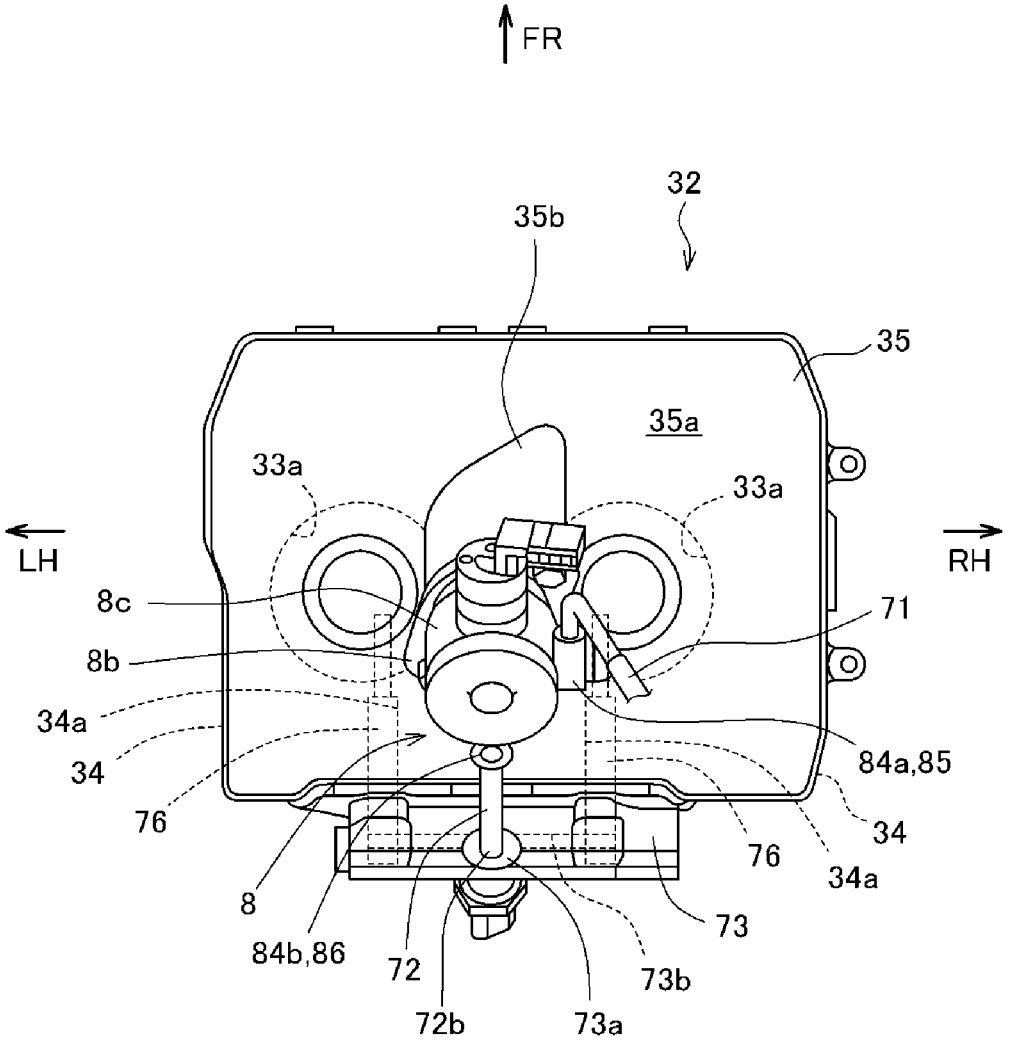
FIG. 3 is a top view of the cylinder unit as viewed in a direction of arrows III-III in FIG. 2.

FIG. 3 is a top view of the cylinder unit 32 as viewed in a direction of arrows III-III in FIG. 2.

As illustrated in FIGS. 2 and 3, two cylinder bores 33*a* are aligned in the vehicle width direction in the cylinder block 33, and a piston 36 slidably fitted in each cylinder bore 33*a* is connected to the crankshaft 31 oriented in the vehicle width direction via a connecting rod (not illustrated).

As illustrated in FIG. 2, a combustion chamber 37 is formed on the lower surface of the cylinder head 34 so as to face the cylinder bore 33*a*. In the cylinder head 34, an intake port 38 and an exhaust port 39 communicating with the combustion chamber 37 are formed to face each other in the front-and-rear direction. The cylinder unit 32 is arranged with an intake valve 42 and an exhaust valve 43 that open and close the combustion chamber 37, the intake port 38, and the exhaust port 39, respectively. The intake-side camshaft 40 and the exhaust-side camshaft 41 constituting a valve train 49 are provided with an intake cam 40*a* and an exhaust cam 41*a* that rotate integrally, respectively.

The intake valve 42 and the exhaust valve 43 are pressed against the intake cam 40*a* and the exhaust cam 41*a*, respectively, by not-illustrated springs via rocker arms 44. The intake-side camshaft 40 and the exhaust-side camshaft 41 have power from the crankshaft 31 transmitted thereto by a not-illustrated cam chain to synchronously rotate at half of the rotation speed of the crankshaft 31, and the intake valve 42 and the exhaust valve 41 open and close at predetermined timings according to the rotation of the crankshaft 31.

As illustrated in FIG. 1, the intake port 38 is connected with an intake device 50 positioned behind the internal combustion engine 3. The intake device 50 includes an air cleaner 51 and a throttle device 52. Dust or the like of the air taken into the internal combustion engine 3 is removed by the air cleaner 51, and an amount of intake air is adjusted by the throttle device 52.

The exhaust port 39 is connected with an exhaust device 55. The exhaust device 55 includes an exhaust pipe 56, a catalyst device (not illustrated), and a muffler 57. The exhaust port 39 is connected with the exhaust pipe 56 toward the front side, and the exhaust pipe 56 is formed to be curved toward the lower side after being directed toward the front side and then directed toward the rear side below the vehicle body. The catalyst device is provided in the middle of the exhaust pipe 56 below the vehicle body. The muffler 57 is connected to the rear end of the exhaust pipe 56, and exhaust of the internal combustion engine 3 is discharged to the outside air from the end of the muffler 57.

In the crankcase 30 of the internal combustion engine 3, the front side is a crank chamber 45, and the rear side is a transmission chamber 46 that houses a transmission (not illustrated), and a so-called power unit is configured. The power of the internal combustion engine 3 is transmitted to the rear wheel 13 via a transmission and a rear wheel driving chain 47 as illustrated in FIG. 1.

As illustrated in FIGS. 1 and 2, the internal combustion engine 3 employs a direct injection type fuel supply device 7 in which fuel is directly supplied to the combustion chamber 37. As illustrated in FIG. 2, the fuel supply device 7 includes the low-pressure fuel pump 70 fixed to a lower surface 16*a* of the fuel tank 16, a high-pressure fuel pump 8 mounted on the head cover 35 of the internal combustion engine 3, a fuel injection valve 76 as a fuel injection device that injects fuel into the combustion chamber 37 of the internal combustion engine 3, a low-pressure fuel pipe 71 that connects the low-pressure fuel pump 70 to the high-pressure fuel pump 8, and a high-pressure fuel pipe 72 that is connected to the high-pressure fuel pump 8 and supplies fuel to the fuel injection valve 76.

The high-pressure fuel pump 8 and the high-pressure fuel pipe 72 are detachably connected to each other. The high-pressure fuel pipe 72 and a fuel supply passage part 73 connected to the downstream end of the high-pressure fuel pipe 72 are connected by caulking and are not detachable from each other.

The low-pressure fuel pump 70 includes a main body 70*a* for pressure-feeding the fuel, and below the main body 70*a*, includes a disk-shaped mounting seat surface 70*b* used for mounting to the fuel tank 16, and below the mounting seat surface 70*b*, includes a fuel outflow part 70*c* connected to the low-pressure fuel pipe 71. In the low-pressure fuel pump 70, the mounting seat surface 70*b* is fixed to the lower surface 16*a* of the fuel tank 16 such that the main body 70*a* is inserted into the fuel tank 16 and the fuel outflow part 70*c* protrudes downward from the fuel tank 16.

The high-pressure fuel pump 8 is one of a positive displacement type driven by the power of the crankshaft 31. As illustrated in FIG. 2, the high-pressure fuel pump 8 includes a main body 8*a*, and on an upper surface of the main body 8*a*, includes a flange-shaped mounting seat surface 8*b*, and above the mounting seat surface 8*b*, includes a fuel flow passage part 8*c*.

The high-pressure fuel pump 8 is inserted until the mounting seat surface 8*b* of the main body 8*a* abuts to a high-pressure fuel pump mounting part 35*b* of the head cover 35, and is fixed to the head cover 35 by bolts 81. The high-pressure fuel pump 8 is mounted on an upper surface 35*a* of the head cover 35 of the cylinder unit 32 in an inclined manner so as to be inclined backward toward the intake-side camshaft 40.

The main body 8*a* of the high-pressure fuel pump 8 includes a pump plunger (hereinafter, simply referred to as a "plunger") 82, a lifter 87 integrated with a lower end 82*b* of the plunger 82, and a spring 83 that biases the lifter 87. The spring 83 is interposed between the lifter 87 and the mounting seat surface 8*b*, and the plunger 82 and the lifter 87 are biased along a lifter guide 80 in a direction away from the mounting seat surface 8*b*.

A fuel flow passage 84 is formed inside the fuel flow passage part 8*c* of the high-pressure fuel pump 8, one end of the fuel flow passage 84 is a suction port 84*a* through which the fuel is sucked into the fuel flow passage 84, and the other end thereof is a discharge port 84*b* through which the fuel is discharged from the fuel high-pressure pump 8. A suction-side joint part 85 is provided on the suction port 84*a* side of the fuel flow passage part 84, the low-pressure fuel pipe 71 is connected to the suction-side joint part 85, and the fuel is sent from the low-pressure fuel pump 70 and flows into the fuel flow passage 84. As illustrated in FIGS. 1 and 2, the suction-side joint part 85 is arranged on the head pipe 20 side of the motorcycle 1.

A discharge-side joint part 86 connected to the high-pressure fuel pipe 72 is provided on the discharge port 84*b* side of the fuel flow passage part 8*c*, the high-pressure fuel pipe 72 is connected to the discharge-side joint part 86, and the fuel increased in pressure by the high-pressure fuel pump 8 is sent to the fuel injection valve 76 through the high-pressure fuel pipe 72.

An upper side 82*a* of the plunger 82 on the fuel flow passage 84 side moves in and out of the fuel flow passage 84 in accordance with the rotation of the exhaust camshaft 41 as described later.

FIG. 3 is a top view of the cylinder unit 32 as viewed in a direction of arrows III-III in FIG. 2, and as illustrated in FIG. 3, the high-pressure fuel pump mounting part 35*b* protruding from the head cover 35 is located at a substantially center of the head cover 35 in the vehicle width direction.

The high-pressure fuel pump 8 of the present embodiment is driven by a plunger driving cam 6 illustrated in FIG. 2 provided so as to rotate integrally with the exhaust camshaft 41, and pressure-feeds the fuel.

That is, a rotatable lifter roller 87*a* of the lifter 87, which is liftably supported by the cylindrical lifter guide 80, abuts to the cam surface of the plunger driving cam 6. On the opposite side of the lifter 87 from the plunger driving cam 6, the plunger 82 having the lower end 82*b* integrally mounted to the lifter 87 is biased and pressed by the spring 83, and the lifter 87 and the plunger 82 move up and down according to the rotation of the exhaust camshaft 41, and the upper side 82*a* of the plunger 82 moves in and out of the fuel flow passage 84.

As illustrated in FIGS. 2 and 3, the cylinder head 34 of the internal combustion engine 3 is formed with a fuel injection valve insertion cylinder part 34*a* communicating with the combustion chamber 37 from the rear side toward the front side of the vehicle for each cylinder. The fuel injection valve 76 as a fuel injection device that injects fuel into the combustion chamber 37 is inserted into the fuel injection valve insertion cylinder part 34*a*.

As illustrated in FIGS. 2 and 3, the fuel supply passage part 73 is provided on the back surface side of the cylinder head 34 in parallel with the crankshaft 30 and directed in the vehicle width direction. At the upper surface center of the fuel supply passage part 73, an inflow port 73*a* to which a downstream-side connection part 72*b* of the high-pressure fuel pipe 72 is provided. Inside the fuel supply passage part 73, a fuel supply passage 73*b* branching laterally from the inflow port 73*a* is provided. The fuel supply passage 73*b* is further connected to the fuel injection valve 76, and the fuel is sent to the fuel injection valve 76.

Figure 4:
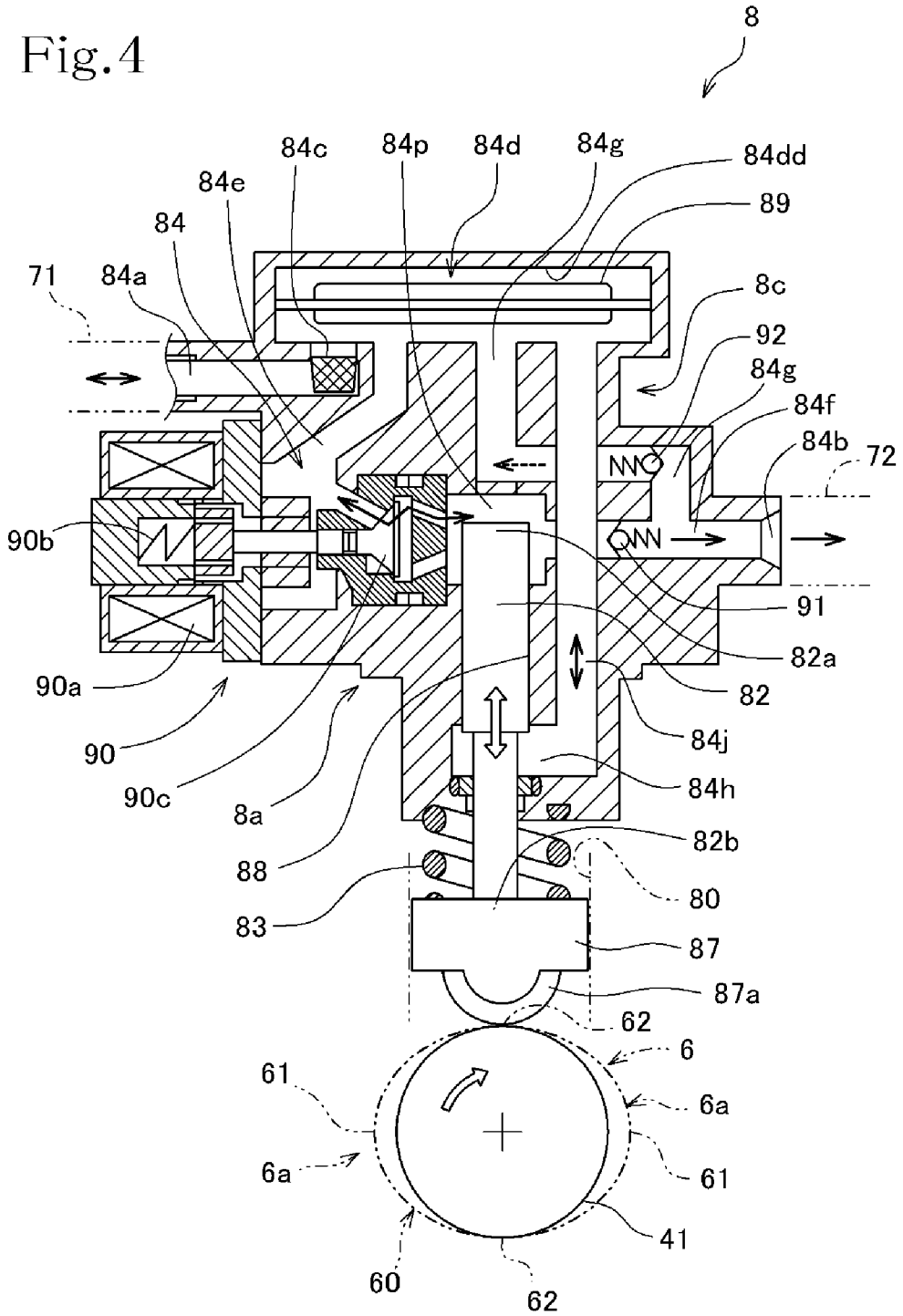
FIG. 4 is a conceptual diagram of a configuration of the high-pressure fuel pump of the present embodiment.

FIG. 4 is a conceptual diagram of a configuration of the high-pressure fuel pump 8 of the present embodiment, and an operation of the high-pressure fuel pump 8 is described.

As a schematic configuration, the high-pressure fuel pump 8 includes the main body 8*a*, the plunger 82 that moves vertically in a circular hole 88 inside the main body 8*a*, a pressurizing chamber 84*p* formed in the middle of the fuel flow passage 84 inside the fuel flow passage part 8*c*, and an electromagnetic spill valve 90. The plunger 82 has the lifter 87 mounted at the lower end 82*b* thereof.

The plunger driving cam 6 is rotatably and integrally provided on the exhaust camshaft 41 ("camshaft" in the present invention) of the valve train 49.

That is, the plunger driving cam 6 rotates synchronously with the exhaust camshaft 41 at half of the rotation speed of the crankshaft 31.

In addition, because the internal combustion engine 3 according to the present embodiment is a four-stroke cycle internal combustion engine as described above, the plunger driving cam 6 rotates by a cam angle of 360° with respect to the rotation with a crank angle of 720° for one cycle of the internal combustion engine.

Because the internal combustion engine according to the present embodiment has two cylinders, the plunger driving cam 6 has two cam ridges 6*a* and 6*a* formed at predetermined angular intervals in one circumference of the exhaust camshaft 41 corresponding to rotation at the cam angle of 360°.

Note that the cam ridges 6*a* and 6*a* in FIG. 4 are temporary shapes for description as indicated by two-dot chain lines, and the cam ridges 6*a* and 6*a* of the present invention are described later.

This forms a configuration in which the plunger driving cam 6 rotates accompanying the rotation of the exhaust camshaft 41 to push up the plunger 82 by the cam ridges 6*a* and 6*a* via the lifter 87, the plunger 82 reciprocates in the circular hole 88, and the volume of the pressurizing chamber 84*p* in the fuel passage 84 is reduced or enlarged.

The pressurizing chamber 84*p* is defined by the plunger 82 and the main body 8*a*. Further, the pressurizing chamber 84*p* communicates with the low-pressure fuel pump 70 via the low-pressure fuel pipe 71 and communicates with the inside of the fuel supply passage part 73 via the high-pressure fuel pipe 72. Specifically, the fuel supply passage part 73 is provided with the fuel supply passage 73*b* corresponding to each cylinder and is further connected to the fuel injection valve 76.

The low-pressure fuel pipe 71 is connected to the fuel flow passage 84 via the suction-side joint part 85, and the fuel flow passage 84 is provided with a filter 84*c*, a pulsation damper 84*d*, the electromagnetic spill valve 90, the pressurizing chamber 84*p*, and a check valve 91 from the suction port 84*a* toward the discharge port 84*b*.

The filter 84*c* provided on the suction side of the high-pressure fuel pump 8 is provided for purifying the fuel sent from the low-pressure fuel pump 70 side.

The pulsation damper 84*d* in the present embodiment is provided with a metal diaphragm 89 enclosing gas having a predetermined pressure in a fuel storage part 84*dd* on the low-pressure fuel pipe 71 side of the fuel flow passage 84, and is provided for suppressing (absorbing) fuel-pressure pulsation in the low-pressure fuel pipe 71 during operation of the high-pressure fuel pump 8.

The electromagnetic spill valve 90 is provided to communicate or block between the pulsation damper 84*d* of the fuel flow passage 84 and the pressurizing chamber 84*p*. The electromagnetic spill valve 90 includes an electromagnetic solenoid 90*a* and opens and closes by controlling energization to the electromagnetic solenoid 90*a*. The electromagnetic spill valve 90 opens by the biasing force of a coil spring 90*b* during stop of the energization to the electromagnetic solenoid 90*a*.

In the state of the energization to the electromagnetic solenoid 90*a* being stopped, the electromagnetic spill valve 90 moves a valve body 90*c* rightward in the drawing by the biasing force of the coil spring 90*b* to open the valve, and the low-pressure fuel pipe 71 and the pressurizing chamber 84*p* communicate with each other through the suction port 84*a*.

In this state, when the plunger 82 moves in a direction of increasing the volume of the pressurizing chamber 84*p*, that is, when the plunger 82 descends (suction stroke) in the drawing, the fuel sent out from the low-pressure fuel pump 70 is sucked into the pressurizing chamber 84*p* through the low-pressure fuel pipe 71.

On the other hand, in the case when the plunger 82 moves in a direction of contracting the volume of the pressurizing chamber 84*p*, that is, when the plunger 82 ascends (pressurization stroke) in the drawing, when the electromagnetic spill valve 90 moves to the left in the drawing against the biasing force of the coil spring 90*b* by the energization to the electromagnetic solenoid 90*a*, the valve body 90*c* moves by the pressurizing force of the plunger 82, the space between the low-pressure fuel pipe 71 and the pressurizing chamber 84*p* is blocked, and when the fuel pressure in the pressurizing chamber 84*p* increases and reaches a predetermined value, the check valve 91 arranged on the pump discharge side opens, and the high-pressure fuel is supplied from the fuel supply passage part 73 to the fuel injection valve 76 through the high-pressure fuel pipe 72.

In addition, an amount of fuel discharge from the high-pressure fuel pump 8 is adjusted by controlling a valve closing period of the electromagnetic spill valve 90 in the pressurization stroke. That is, the control is made so that the amount of fuel discharge increases by advancing the valve closing start timing of the electromagnetic spill valve 90 and lengthening the valve closing period, and the amount of fuel discharge decreases by delaying the valve closing start timing of the electromagnetic spill valve 90 and shortening the valve closing period. In this manner, the fuel pressure in the fuel supply passage part 73 is controlled by adjusting the amount of fuel discharge of the high-pressure fuel pump 8.

As illustrated in FIG. 4, in the high-pressure fuel pump 8, the pulsation damper 84*d* is integrally provided in the middle of the fuel passage 84.

Further, the main body 8*a* of the high-pressure fuel pump 8 is formed with the circular hole 88 extending upward from the lower surface thereof and the pressurizing chamber 84*p* extending upward from the upper end of the circular hole 88, and the cylindrical plunger 82 is vertically movably inserted into the circular hole 88.

The upper side 82*a* of the plunger 82 is arranged to enter and retract into and from the pressurizing chamber 84*p* when the plunger 82 ascends and descends, which reduces and increases the volume of the pressurizing chamber 84*p*. The lower end 82*b* of the plunger 82 is arranged so as to protrude downward through an opening that is the lower end of the circular hole 88.

In the lower portion of the main body 8*a*, the cylindrical lifter guide 80 surrounding the opening of the circular hole 88 extends downward, and the cylindrical lifter 87 is fitted inside the lifter guide 80 so as to be vertically movable. The lifter roller 87*a* is rotatably provided inside the lifter 87.

The lower end 82*b* of the plunger 82 is mounted on the lifter 87 with a not-illustrated retainer interposed therebetween, and the spring 83 that biases the lifter 87 toward the plunger driving cam 6 side is arranged between the lifter 87 and the main body 8*a*.

The lifter roller 87*a* is pressed against the cam surface of the plunger driving cam 6 provided in the exhaust camshaft 41 by the biasing force of the spring 83, and in conjunction with the crankshaft 31 of the internal combustion engine 3, the exhaust camshaft 41 synchronously rotates at a rotation speed that is half of the rotation speed of the crankshaft 31.

With the above configuration, when the contact point of the plunger driving cam 6 to the lifter roller 87*a* rotates from a valley bottom 62 to an apex 61 in synchronization with the rotation of the crankshaft 31, the lifter 87 receives the pressing force against the downward biasing force of the spring 83 from the plunger driving cam 6 and moves upward. Meanwhile, because the plunger 82 attached to the lifter 87 also ascends the circular hole 88 and the upper side 82*a* of the plunger 82 continues to enter the pressurizing chamber 84*p*, the volume occupied by the fuel decreases by the amount of the plunger 82 entering the pressurizing chamber 84*p*. Therefore, a positive pressure that is a pressure higher than the pressure (feed pressure) of fuel sent from the low-pressure fuel pump 70 is generated inside the pressurizing chamber 84*p* according to the amount of entry of the plunger 82. In the present embodiment, a stroke in which the upper side 82*a* of the plunger 82 enters the pressurizing chamber 84*p* as described above is referred to as the "pressurization stroke".

On the other hand, when the contact point of the plunger driving cam 6 to the lifter roller 87*a* rotates from the apex 61 to the valley bottom 62, the lifter 87 moves downward following the bias of the spring 83. Meanwhile, because the upper side 82*a* of the plunger 82 continues to retract from the pressurizing chamber 84*p*, the volume occupied by the fuel in the pressurizing chamber 84*p* expands by an amount by which the plunger 82 retracts. Therefore, a negative pressure that is a pressure lower than the feed pressure is formed inside the pressurizing chamber 84*p* according to the amount of retraction of the plunger 3. In the present embodiment, a stroke in which the upper side 82*a* of the plunger 82 retracts from the pressurizing chamber 84*p* as described above is referred to as the "suction stroke".

In the fuel flow passage 84, a fuel suction passage 84*e* that communicates between the pressurizing chamber 84*p* and the pulsation damper 84*d* is formed on one side (left side in FIG. 4) of the pressurizing chamber 84*p*, and the electromagnetic spill valve 90 that switches the fuel suction passage 84*e* between a communicating state and a non-communicating state is provided in the middle of the fuel suction passage 84*e*. The electromagnetic spill valve 90 includes the electromagnetic solenoid 90*a* for moving the valve body 90*c* between a valve closing position and a valve opening position, and when the electromagnetic solenoid 90*a* is in a non-energized state, the valve body 90*c* is arranged in the valve opening position to bring the fuel suction passage 84*e* into the communicating state. Further, the electromagnetic spill valve 90 allows the valve body 90*c* to move to the valve closing position when the electromagnetic solenoid 90*a* is in the energized state according to a command from a not-illustrated electronic control device, and brings the fuel suction passage 84*e* into the non-communicating state.

In the present embodiment, when the electromagnetic spill valve 90 is open in the pressurization stroke, the fuel having a volume corresponding to an amount reduced in the pressurizing chamber 84*p* is returned from the pressurizing chamber 84*p* to the upstream side. When the electromagnetic spill valve 90 closes in the pressurization stroke, the fuel having a volume corresponding to an amount reduced in the pressurizing chamber 84*p* is pressure-fed from the pressurizing chamber 84*p* to the downstream side.

Therefore, an amount of pressure-feeding and the pressure of the high-pressure fuel are adjusted by adjusting the valve closing period of the electromagnetic spill valve 90.

In the fuel flow passage 84, a discharge passage 84*f* that communicates between the pressurizing chamber 84*p* and the high-pressure fuel pipe 72 is formed on the opposite side of the electromagnetic spill valve 90 with the pressurizing chamber 84*p* interposed therebetween. The discharge passage 84*f* is provided with the check valve 91 for regulating backflow of fuel from the high-pressure fuel pipe 72.

Further, a return flow passage 84*g* branches from the discharge passage 84*f* on the downstream side of the check valve 91, and the return flow passage 84*g* communicates with the pulsation damper 84*d* via a relief valve 92. When the pressure of the high-pressure fuel in the discharge passage 84*f* becomes a predetermined value or higher, the high-pressure fuel is returned to the pulsation damper 84*d* side on the upstream side of the pressurizing chamber 84*p* by the relief valve 92, and the excessive amount of pressure-feeding and pressure of the high-pressure fuel are suppressed.

Further, an auxiliary chamber 84*h* formed around the lower portion of the plunger 82 is provided with an auxiliary chamber passage 84*j* that communicate the auxiliary chamber 84*h* and the pulsation damper 84*d* with each other to release back pressure generated by the upper and lower portions of the plunger 82.

In general, a two-cylinder four-stroke cycle internal combustion engine in which two cylinders form such as a 360° phase crank or a 180°/180° phase crank may be used, but the internal combustion engine 3 of the present invention is an unequal interval two-cylinder four-stroke cycle internal combustion engine with the 270°/90° phase crank.

In the case of the two-cylinder 360° phase crank, with respect to a 720° crank angle in one cycle, the combustion stroke of both cylinders has equal interval with a cycle having a crank angle of 360°, and the plunger driving cam 6 has a cycle having a cam angle of 180°.

In the present embodiment, the high-pressure fuel is supplied from one high-pressure fuel pump 8 to both cylinders.

Therefore, in the plunger driving cam 6 provided in the exhaust camshaft 41, two cam ridges 6*a* are provided for the cam angle of 360° corresponding to one cycle.

In the case of the plunger driving cam 6 temporarily illustrated in FIG. 4, two cam ridges 6*a* each having the cam angle of 180° are provided at equal intervals as indicated by a two-dot chain line, and phase position of the cam ridge is set such that the high-pressure fuel is sent from the high-pressure fuel pump 8 to the fuel injection valve 76 of each cylinder in good timing.

The cam ridges 6*a* as exemplified in FIG. 4 form so-called 180° symmetric cam in which one ridge forms the cam angle of 180°, and an ascending side advancing from the valley bottom 62 to the apex 61 and causing the plunger 82 to perform the pressurization stroke and a descending side advancing from the apex 61 to the valley bottom 62 and causing the plunger 82 to perform the suction stroke are formed in a symmetrical shape.

In contrast thereto, in the case of the unequal interval two-cylinder four-stroke cycle internal combustion engine with the 270°/90° phase crank according to the embodiment of the present invention, it is difficult to set the phase position of the cam ridge 6*a* of the plunger driving cam 6 in which the high-pressure fuel is sent from the high-pressure fuel pump 8 to the fuel injection valve 76 in good timing with respect to the intake stroke prior to the combustion stroke of each cylinder with the 180° symmetric cam as described above.

Figure 5:
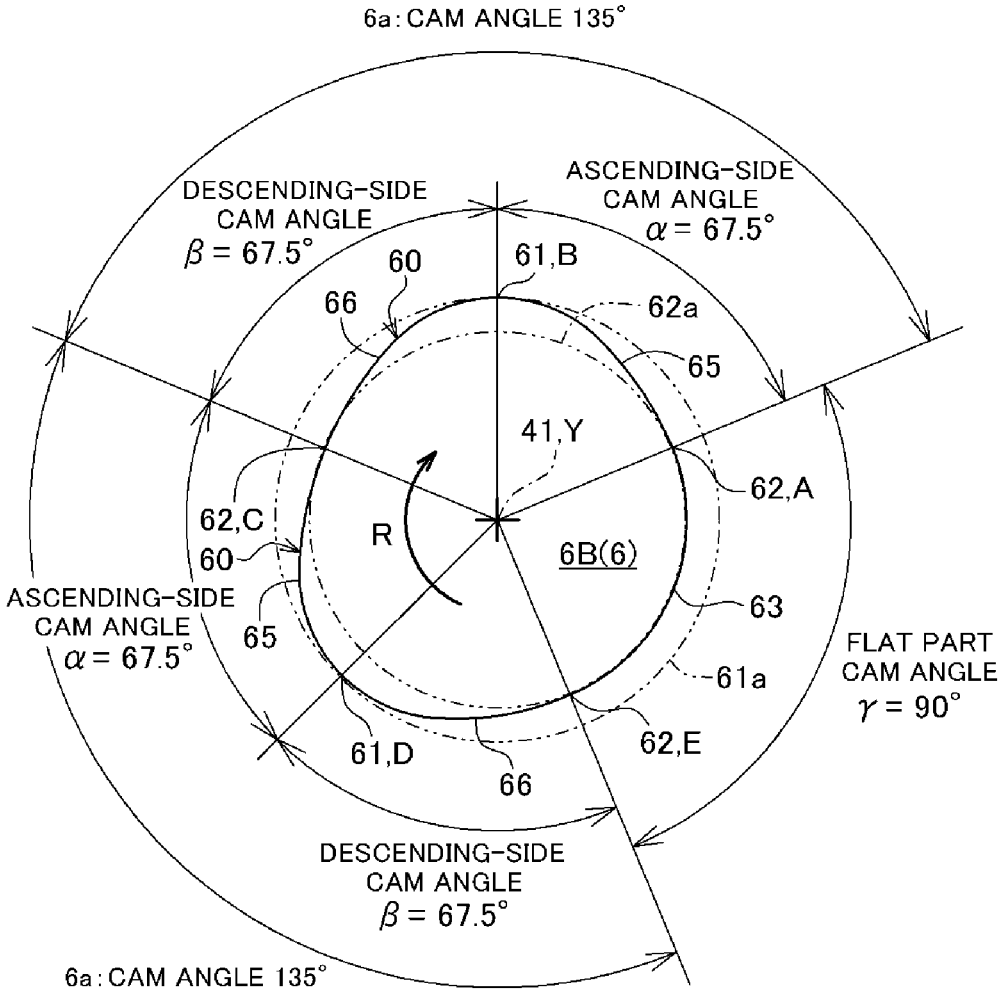
FIG. 5 is a cam profile view of a 135° symmetric cam of a study example as viewed in an axial direction of an exhaust camshaft.
Figure 6:
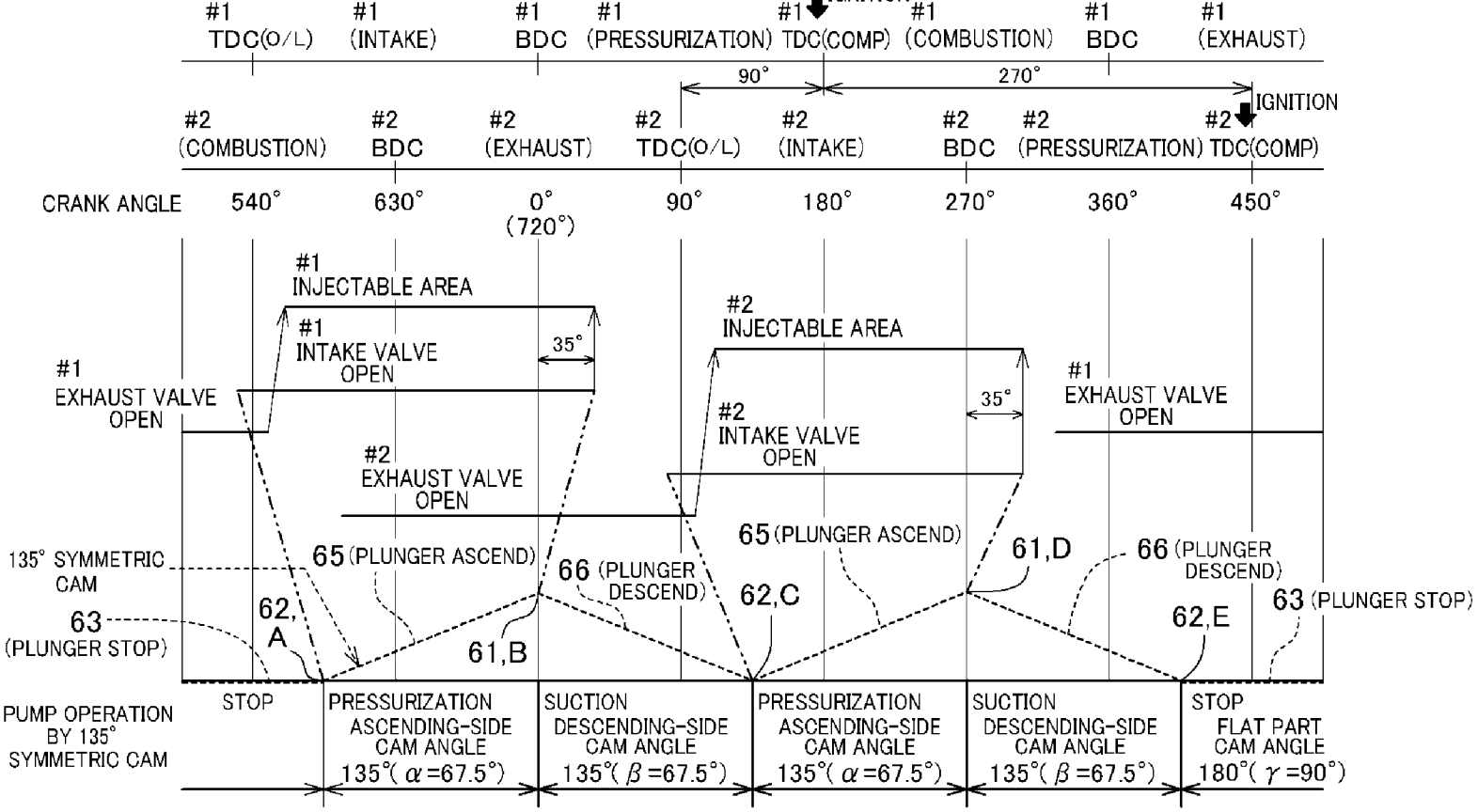
FIG. 6 is an explanatory diagram of the relationship between the operation of the high-pressure fuel pump by the 135° symmetric cam of the study example and the operation of the unequal interval two-cylinder four-stroke cycle internal combustion engine with a 270°/90° phase crank.

Therefore, the present inventors have studied a 135° symmetric cam 6B as illustrated in FIGS. 5 and 6 to enable the phase position of the cam ridge 6*a* of the plunger driving cam 6 to be set such that the high-pressure fuel is sent from the high-pressure fuel pump 8 to the fuel injection valve 76 in good timing with respect to the intake stroke prior to the combustion stroke of each cylinder even in the case of the unequal interval two-cylinder four-stroke cycle internal combustion engine with the 270°/90° phase crank according to the embodiment of the present invention.

FIG. 5 is a cam profile view of the 135° symmetric cam 6B of the study example as viewed in a direction of an exhaust camshaft axis Y.

As illustrated in FIG. 5, the 135° symmetric cam 6B of the study example is the plunger driving cam 6 in which one ridge of the cam ridges 6*a* forms a cam angle of 135°, and an ascending side 65 advancing from the valley bottom 62 to the apex 61 and causing the plunger 82 to perform the pressurization stroke and a descending side 66 advancing from the apex 61 to the valley bottom 62 and causing the plunger 82 to perform the suction stroke are formed in a symmetrical shape. In the case of the present study example, two ridges of the 135° symmetric cam 6B are continuously provided around the exhaust camshaft 41.

The remaining portion of the two ridges of the 135° symmetric cam 6B where a flat part cam angle $\gamma=90°$ is formed on a flat part 63 where the cam ridge 6*a* is not provided by having the valley bottom 62 continuously formed.

Note that, in FIG. 5, a reference numeral 61*a* denotes an apex trajectory of the apex 61 of the cam ridge 6*a*, and a reference numeral 62*a* denotes a valley bottom trajectory of the valley bottom 62 of the cam ridge 6*a*.

In FIG. 5, assuming that a rotation direction R of the 135° symmetric cam 6B is the clockwise direction, and following the rotation direction R, assuming that the valley bottom 62 of the cam ridge 6*a* following the flat part 63 is a point A, the apex 61 following the point A is a point B, the valley bottom 62 following the point B is a point C, the apex 61 following the point C is a point D, and the valley bottom 62 following the point D is a point E, the ascending side 65 of the cam ridge 6*a* from the point A to the point B is formed at an ascending-side cam angle $\alpha=67.5°$, the descending side 66 of the cam ridge 6*a* from the point B to the point C is formed at a descending-side cam angle $\beta=67.5°$, the ascending side 65 of the cam ridge 6*a* from the point C to the point D is formed at the ascending-side cam angle $\alpha=67.5°$, and the descending side 66 of the cam ridge 6*a* from the point D to the point E is formed at the descending-side cam angle $\beta=67.5°$.

As described above, the flat part 63 is formed from the point E to the point A over the flat part cam angle $\gamma=90°$.

FIG. 6 is an explanatory diagram of the relationship between the operation of the high-pressure fuel pump 8 by the 135° symmetric cam 6B of the study example and the operation of the unequal interval two-cylinder four-stroke cycle internal combustion engine with the 270°/90° phase crank.

In FIG. 6, the stroke of each cylinder in the unequal interval two-cylinder four-stroke cycle internal combustion engine with the 270°/90° phase crank is illustrated in the upper part, and the opening periods of the intake valve and the exhaust valve of each cylinder and the corresponding "injectable area" of the fuel injection valve 76 regarding the above stroke are illustrated in the middle part.

The length of each stroke, the valve opening period, and the "injectable area" is indicated by the crank angle.

The time series is assumed to transition from the left side to the right side in the drawing.

"#1" indicates a first cylinder among two cylinders, and "#2" indicates a second cylinder.

"TDC" indicates a top dead center of the piston 36, and "BDC" indicates a bottom dead center of the piston 36.

From the relationship of strokes of each cylinder shown in the upper part, it is clearly indicated that the internal combustion engine 3 according to the present embodiment is the internal combustion engine with unequal interval crank angle of 270°/90° phase.

The "injectable area" indicates that the intake valve 42 is in the "open" state and after the "open" of the exhaust valve ends, that is, after the exhaust valve closes.

The lower part of FIG. 6 illustrates the height position of the cam ridge 6*a* abutting to the plunger 82 of the plunger driving cam 6, that is, the 135° symmetric cam 6B of the study example illustrated in FIG. 5, and the operation state of the high-pressure fuel pump 8.

Here, the rotation position of the cam ridge 6*a* is set such that the apex 61 of the cam ridge 6*a* is aligned with the BDC of the first cylinder (#1) before the intake valve 42 of the first cylinder (#1) closes.

Note that the height position of the cam ridge 6*a* indicates the apex 61 and the valley bottom 62, and the portion therebetween, which is actually a curve, is simply indicated by a straight line. The operation of the plunger 82 regarding the displacement in height position of the cam ridge 6*a* is also written in parentheses.

The ascending-side cam angle α on the ascending side 65 of the cam ridge 6*a* corresponding to the pressurization stroke of the high-pressure fuel pump 8 is also written in parentheses, and the descending-side cam angle β on the descending side 66 of the cam ridge 6*a* corresponding to the suction stroke is also written in parentheses.

In addition, the flat part cam angle γ of the flat part 63 of the cam ridge 6*a* corresponding to the stop of operation of the high-pressure fuel pump 8 is also written in parentheses.

Because the cam angles α, β, and γ are the angles in the exhaust camshaft 41 rotating at half of the rotation speed of the crankshaft 31, the cam angles α, β, and γ are angles that are half of the corresponding crank angle.

The "injectable area" of the fuel injection valve 76 is desired to be as wide as possible so that the decrease in fuel discharge pressure can be reduced and the engine performance can be improved even in the case where the fuel discharge period is long, and at the same time, it is desirable that the "injectable area" be covered as wide as possible in a pressurization stroke range (an ascending range of the plunger 82) of the high-pressure fuel pump 8.

According to the 135° symmetric cam 6B of the present study example, as illustrated in FIG. 6, the pressurization stroke range (the ascending range of the plunger 82: from the point A to the point B) of the high-pressure fuel pump 8 covers most of the first cylinder (#1) except for a part before and after the opening range of the intake valve 42, and thus covers most of the "injectable area" of the first cylinder (#1).

Further, the pressurization stroke range (the ascending range of the plunger 82: from the point C to the point D) of the high-pressure fuel pump 8 covers most of the second cylinder (#2) except for a part before and after the opening range of the intake valve 42, and thus covers most of the "injectable area" of the second cylinder (#2).

Therefore, for the unequal interval two-cylinder four-stroke cycle internal combustion engine with the 270°/90° phase crank, the 135° symmetric cam 6B shows a relatively good compatibility with respect to the "injectable area" of the fuel injection valve 76.

However, the plunger 82 ascends and descends along the cam curved surface 60 along with the up and down movement of the cam ridge 6*a*, whereas the cam ridge 6*a* of the 135° symmetric cam 6B of the present study example has the flat part 63. Therefore, the continuity of the cam curved surface 60 stops at the point E that is the start point of the flat part 63 or the point A that is the end point thereof, and it has been found that two-step movement is generated in the plunger 82 and the vibration accompanying the fuel transfer in the high-pressure fuel pump 8 becomes irregular (discontinuous), and a problem also occurs in the followability of the pulsation damper 84*d*.

Therefore, as a result of intensive research, the present inventors have found a 180° asymmetric cam 6A according to the high-pressure fuel pump 8 of the present invention described below.

Figure 7:
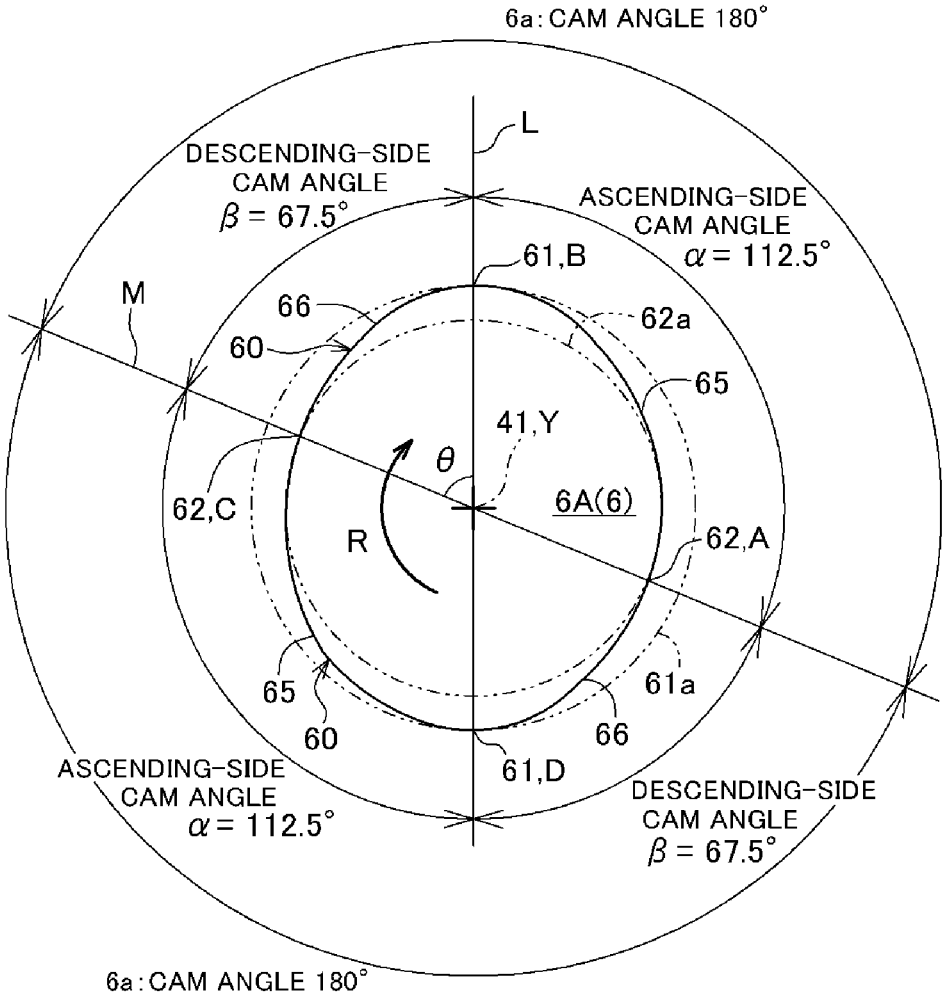
FIG. 7 is a cam profile view of a 180° asymmetric cam of the embodiment of the present invention as viewed in an axial direction of the exhaust camshaft.

FIG. 7 is a cam profile view of a 180° asymmetric cam 6A of the embodiment of the present invention as viewed in a direction of the exhaust camshaft axis Y.

As illustrated in FIG. 7, in the 180° asymmetric cam 6A as the plunger driving cam 6 according to the embodiment of the present invention, one ridge of the cam ridges 6*a* forms a cam angle of 180°, and the ascending side 65 advancing from the valley bottom 62 to the apex 61 and causing the plunger 82 to perform the pressurization stroke and the descending side 66 advancing from the apex 61 to the valley bottom 62 and causing the plunger 82 to perform the suction stroke are formed in an asymmetrical shape. In the case of the present embodiment, two peaks of the 180° asymmetric cam 6A are continuously provided around the exhaust camshaft 41.

That is, the two cam ridges 6*a* provided on the exhaust camshaft 41 include the continuous cam curved surface 60 that includes two apexes 61 at a cam angle interval of 180° and two valley bottoms 62 at a cam angle interval of 180° and alternately connects the apexes 61 and the valley bottoms 62, and a crossing angle θ between a first virtual line L connecting the two apexes 61 and a second virtual line M connecting the two valley bottoms 62 being not a right angle as viewed in a direction of an exhaust camshaft axis Y ("camshaft axis" in the present invention).

Therefore, the pressurization timing of the high-pressure fuel pump 8 can be set at unequal intervals, the apexes 61 and the valley bottoms 62 of the cam ridges 6*a* of the plunger driving cam 6 are continuously formed to generate no flat part in the cam lift characteristics and to make the vibration accompanying the fuel transfer in the high-pressure fuel pump 8 be regular, the followability of the pulsation damper 84*d* becomes favorable, and the pump performance of the high-pressure fuel pump 8 is improved and stabilized. For these reasons, the high-pressure fuel pump 8 having high accuracy for the unequal interval two-cylinder internal combustion engine can be obtained while operation characteristics of the high-pressure fuel pump 8 are maintained.

Also in FIG. 7, the reference numeral 61*a* denotes the apex trajectory of the apex 61 of the cam ridge 6*a*, and the reference numeral 62*a* denotes the valley bottom trajectory of the valley bottom 62 of the cam ridge 6*a*.

In FIG. 7, assuming that the rotation direction R of the 180° asymmetric cam 6A is the clockwise direction, and following the rotation direction R, assuming that, for example, the valley bottom 62 of the cam ridge 6*a* on the right side is the point A, the apex 61 following the point A is the point B, the valley bottom 62 following the point B is the point C, and the apex 61 following the point C is the point D, the valley bottom 62 following the pint D is the point A. The ascending side 65 of the cam ridge 6*a* from the point A to the point B is formed at the ascending-side cam angle α=112.5°, the descending side 66 of the cam ridge 6*a* from the point B to the point C is formed at the descending-side cam angle β=67.5°, the ascending side 65 of the cam ridge 6*a* from the point C to the point D is formed at the ascending-side cam angle α=112.5°, and the descending side 66 of the cam ridge 6*a* from the point D to the point A is formed at the descending-side cam angle β=67.5°.

Therefore, the crossing angle θ between the first virtual line L and the second virtual line M is approximately 67.5° on the acute angle side, and as is described later, the fuel pressurization stroke of the high-pressure fuel pump 8 shows good compatibility with respect to the "injectable area" of the fuel injection valve 76, and the pump performance of the high-pressure fuel pump 8 in the unequal interval crank angle two-cylinder four-stroke cycle internal combustion engine in the 270°/90° phase is improved.

In addition, because the ascending-side cam angle α of 112.5° on the ascending side in the rotation direction R of the cam ridge 6*a* is larger than the descending-side cam angle β of 67.5° on the descending side, the pressurization stroke becomes longer than the suction stroke, and the action becomes smooth.

Therefore, the "injectable area" of the fuel injection valve 76 can be enlarged as described later, and the decrease in fuel discharge pressure can be reduced even when the fuel discharge period is large, and the internal combustion engine performance can be improved.

Note that in the case of setting the crossing angle θ to approximately 45° to 67.5° on the acute angle side, by widening the angle on the discharge side, the discharge timing region in the unequal interval two-cylinder four-stroke cycle internal combustion engine with the 270°/90° phase crank is enlarged, and the engine can be controlled in a wide rotation range.

In addition, in the case of setting the crossing angle θ to approximately 67.5° to 90° on the acute angle side, by making the cam angle on the descending side relatively wide, in the unequal interval two-cylinder four-stroke cycle internal combustion engine with the 270°/90° phase crank, the return of the plunger 82 can be made gentle even with unequal intervals. Therefore, the load of the spring 83 for returning the plunger 82 can be reduced, and the operation friction of the high-pressure fuel pump 8 can be reduced.

Figure 8:
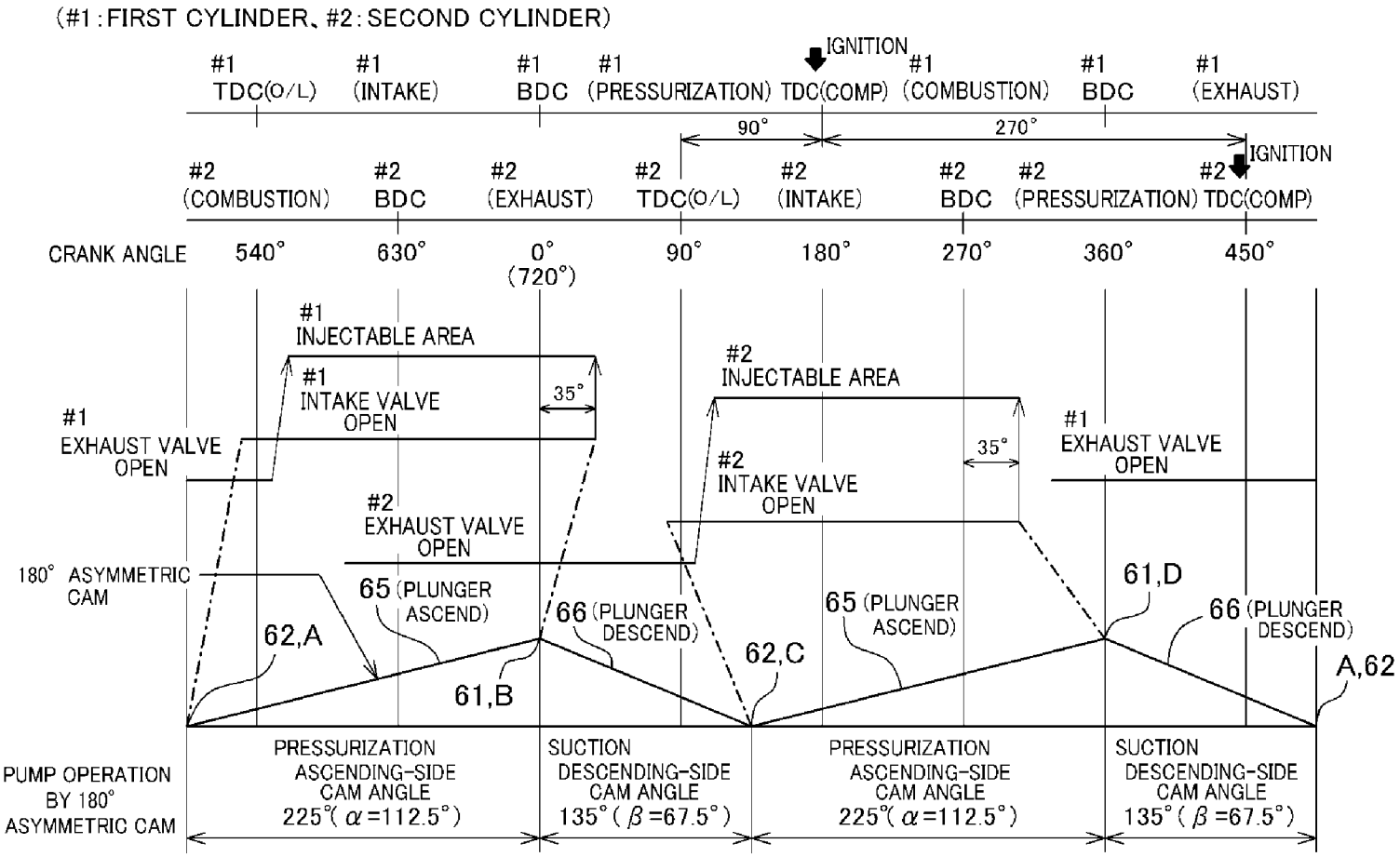
FIG. 8 is an explanatory diagram of the relationship between the operation of the high-pressure fuel pump by the 180° asymmetric cam of the present embodiment and the operation of the unequal interval two-cylinder four-stroke cycle internal combustion engine with the 270°/90° phase crank.

FIG. 8 is an explanatory diagram of the relationship between the operation of the high-pressure fuel pump 8 by the 180° asymmetric cam 6A of the present embodiment and the operation of the unequal interval two-cylinder four-stroke cycle internal combustion engine with the 270°/90° phase crank.

In FIG. 8, similarly to FIG. 6, the stroke of each cylinder in the unequal interval two-cylinder four-stroke cycle internal combustion engine with the 270°/90° phase crank is illustrated in the upper part, and the opening periods of the intake valve and the exhaust valve of each cylinder and the corresponding "injectable area" of the fuel injection valve 76 regarding the above stroke are illustrated in the middle part.

The notations are the same as those in FIG. 6.

The lower part of FIG. 8 illustrates the height position of the cam ridge 6*a* abutting to the plunger 82 of the plunger driving cam 6, that is, the 180° asymmetric cam 6A of the present embodiment illustrated in FIG. 7, and the operation state of the high-pressure fuel pump 8.

Here, the rotation position of the cam ridge 6*a* is set such that the apex 61 of the cam ridge 6*a* is aligned with the BDC of the first cylinder (#1) before the intake valve of the first cylinder (#1) closes.

Note that the height position of the cam ridge 6*a* indicates the apex 61 and the valley bottom 62, and the portion therebetween, which is actually a curve, is simply indicated by a straight line. The operation of the plunger 82 regarding the displacement in height position of the cam ridge 6*a* is also written in parentheses.

The ascending-side cam angle α on the ascending side 65 of the cam ridge 6*a* corresponding to the pressurization stroke of the high-pressure fuel pump 8 is also written in parentheses, and the descending-side cam angle β on the descending side 66 of the cam ridge 6*a* corresponding to the suction stroke is also written in parentheses.

Because the cam angles α and β are the angles in the exhaust camshaft 41 rotating at half of the rotation speed of the crankshaft 31, the cam angles α and β are angles that are half of the corresponding crank angle.

The "injectable area" of the fuel injection valve 76 is desired to be as wide as possible so that the decrease in fuel discharge pressure can be reduced and the engine performance can be improved even in the case where the fuel discharge period is long, and at the same time, it is desirable that the "injectable area" be covered as wide as possible in the pressurization stroke range (the ascending range of the plunger 82) of the high-pressure fuel pump 8.

According to the 180° asymmetric cam 6A of the present embodiment, as illustrated in FIG. 8, the pressurization stroke range (the ascending range of the plunger 82: from the point A to the point B) of the high-pressure fuel pump 8 covers most of the first cylinder (#1) except for a part after the opening range of the intake valve 42, and thus covers most of the "injectable area" of the first cylinder (#1).

Further, the pressurization stroke range (the ascending range of the plunger 82: from the point C to the point D) of the high-pressure fuel pump 8 covers most of the second cylinder (#2) except for a part before the opening range of the intake valve 42, and thus covers most of the second cylinder (#2) except for a part before the "injectable area".

Therefore, for the unequal interval two-cylinder four-stroke cycle internal combustion engine with the 270°/90° phase crank, the 180° asymmetric cam 6A shows a very good compatibility with respect to the "injectable area" of the fuel injection valve 76.

Moreover, because the plunger 82 continuously ascends and descends along with the continuous up and down movement of the cam ridge 6*a*, the 180° asymmetric cam 6A does not have the flat part 63 as in the case of the 135° target cam 6B of the study example, and the apex 61 and the valley bottom 62 of the cam ridge 6*a* are continuously formed. This generates no flat part in the cam lift characteristics, and the pump performance of the high-pressure fuel pump 8 is improved and stabilized. Therefore, the vibration irregularity associated with the fuel transfer in the high-pressure fuel pump 8 is suppressed, and the followability of the pulsation damper 84*d* is also improved.

Further, in the high-pressure fuel pump 8 of the present embodiment, because the plunger driving cam 6 is provided coaxially with the exhaust camshaft 41 ("valve camshaft" in the present invention) which is a valve camshaft of the valve train 49 provided in the cylinder head 34 in the upper portion of the cylinder unit 32 of the internal combustion engine 3, the structure of the internal combustion engine 3 including the high-pressure fuel pump 8 can be downsized.

Still further, the high-pressure fuel pump 8 is provided in the head cover 35 in the upper portion of the cylinder unit 32 of the internal combustion engine 3 of the motorcycle 1 that is the straddle type vehicle, and the low-pressure fuel pipe ("fuel pipe" in the present invention) 71 is provided between the high-pressure fuel pump 8 and the fuel tank 16 located above the internal combustion engine 3. Therefore, the low-pressure fuel pipe 71 can be shortened, the vibration of the low-pressure fuel pipe 71 is reduced, and the layout of the low-pressure fuel pipe 71 is improved.

Although one embodiment of the present invention has been described above, it is needless to say that aspects of the present invention are not limited to the above embodiment and include those implemented in various aspects within the scope of the present invention.

For example, the high-pressure fuel pump of the present invention is not limited to that of the embodiment as long as the high-pressure fuel pump satisfies the requirements of each claim, and the straddle type vehicle is not limited to the motorcycle shown in the embodiment.

Further, for convenience of description, the arrangement of the devices has been described according to the embodiment. However, for example, the devices may be arranged in a laterally reversed manner as long as the functions and effects are substantially the same.

REFERENCE SIGNS LIST

1 motorcycle ("straddle type vehicle" in the present invention)
2 vehicle body frame
3 internal combustion engine
6 plunger driving cam
6*a* cam ridge
6A 180° asymmetric cam
6B 135° symmetric cam
7 fuel supply device
8 high-pressure fuel pump
8*a* main body
8*b* mounting seat surface
8*c* fuel flow passage part
16 fuel tank
31 crankshaft
32 cylinder unit
33 cylinder block
33*a* cylinder bore
34 cylinder head
36 piston
37 combustion chamber
38 intake port
39 exhaust port
41 exhaust camshaft ("valve camshaft" in the present invention)
41*a* exhaust cam
42 intake valve
43 exhaust valve
49 valve train
60 cam curved surface
61 apex
61*a* apex trajectory
62 valley bottom
62*a* valley bottom trajectory
63 flat part
65 ascending side
66 descending side
70 low-pressure fuel pump
71 low-pressure fuel pipe ("fuel pipe" in the present invention)
72 high-pressure fuel pipe
76 fuel injection valve
80 lifter guide
82 plunger ("pump plunger" of the present invention)
84 fuel flow passage
84*p* pressurizing chamber
84*d* pulsation damper
87 lifter
87*a* lifter roller
90 electromagnetic spill valve
90*c* valve body
91 check valve
92 relief valve
X cylinder axis
Y exhaust camshaft axis ("camshaft axis" in the present invention)
α ascending-side cam angle
β descending-side cam angle
γ flat part cam angle
L first virtual line
M second virtual line
θ crossing angle

The invention claimed is:

1. A high-pressure fuel pump of a reciprocating type that operates a plunger while facing a cam ridge of a plunger driving cam provided on a camshaft to which power of a crankshaft of an internal combustion engine is transmitted, wherein the cam ridge includes a cam curved surface including two apexes at a cam angle interval of 180° and two valley bottoms at a cam angle interval of 180° and alternately connecting the apexes and the valley bottoms, and has a crossing angle that is not a right angle as viewed in a direction of a camshaft axis, the crossing angle being an angle between a first virtual line connecting the two apexes and a second virtual line connecting the two valley bottoms, and the cam ridge has an ascending-side cam angle larger than a descending-side cam angle in a predetermined rotation direction.

2. The high-pressure fuel pump according to claim 1, wherein the crossing angle is approximately 67.5° on an acute angle side.

3. The high-pressure fuel pump according to claim 1, wherein the crossing angle is approximately 45° to 67.5° on an acute angle side.

4. The high-pressure fuel pump according to claim 3, wherein the cam ridge has an ascending-side cam angle larger than a descending-side cam angle in a predetermined rotation direction.

5. The high-pressure fuel pump according to claim 4, wherein the high-pressure fuel pump has the plunger driving cam provided coaxially with a valve camshaft of a valve train provided in an upper portion of a cylinder unit of the internal combustion engine.

6. The high-pressure fuel pump according to claim 4, wherein the high-pressure fuel pump is provided in an upper portion of a cylinder unit of the internal combustion engine of a straddle type vehicle, and has a fuel pipe provided between the high-pressure fuel pump and a fuel tank located above the internal combustion engine.

7. The high-pressure fuel pump according to claim 3, wherein the high-pressure fuel pump has the plunger driving cam provided coaxially with a valve camshaft of a valve train provided in an upper portion of a cylinder unit of the internal combustion engine.

8. The high-pressure fuel pump according to claim 3, wherein the high-pressure fuel pump is provided in an upper portion of a cylinder unit of the internal combustion engine of a straddle type vehicle, and has a fuel pipe provided between the high-pressure fuel pump and a fuel tank located above the internal combustion engine.

9. The high-pressure fuel pump according to claim 1, wherein the crossing angle is approximately 67.5° to 90° on an acute angle side.

10. The high-pressure fuel pump according to claim 9, wherein the cam ridge has an ascending-side cam angle larger than a descending-side cam angle in a predetermined rotation direction.

11. The high-pressure fuel pump according to claim 10, wherein the high-pressure fuel pump has the plunger driving cam provided coaxially with a valve camshaft of a valve train provided in an upper portion of a cylinder unit of the internal combustion engine.

12. The high-pressure fuel pump according to claim 10, wherein the high-pressure fuel pump is provided in an upper portion of a cylinder unit of the internal combustion engine of a straddle type vehicle, and has a fuel pipe provided between the high-pressure fuel pump and a fuel tank located above the internal combustion engine.

13. The high-pressure fuel pump according to claim 9, wherein the high-pressure fuel pump has the plunger driving cam provided coaxially with a valve camshaft of a valve train provided in an upper portion of a cylinder unit of the internal combustion engine.

14. The high-pressure fuel pump according to claim 9, wherein the high-pressure fuel pump is provided in an upper portion of a cylinder unit of the internal combustion engine of a straddle type vehicle, and has a fuel pipe provided between the high-pressure fuel pump and a fuel tank located above the internal combustion engine.

15. The high-pressure fuel pump according to claim 1, wherein the high-pressure fuel pump is provided in an upper portion of a cylinder unit of the internal combustion engine of a straddle type vehicle, and has a fuel pipe provided between the high-pressure fuel pump and a fuel tank located above the internal combustion engine.

16. A high-pressure fuel pump of a reciprocating type that operates a plunger while facing a cam ridge of a plunger driving cam provided on a camshaft to which power of a crankshaft of an internal combustion engine is transmitted, wherein the cam ridge includes a cam curved surface including two apexes at a cam angle interval of 180° and two valley bottoms at a cam angle interval of 180° and alternately connecting the apexes and the valley bottoms, and has a crossing angle that is not a right angle as viewed in a direction of a camshaft axis, the crossing angle being an angle between a first virtual line connecting the two apexes and a second virtual line connecting the two valley bottoms, and the high-pressure fuel pump has the plunger driving cam provided coaxially with a valve camshaft of a valve train provided in an upper portion of a cylinder unit of the internal combustion engine.

* * * * *